US005692825A

United States Patent [19]

Shalvi

[11] Patent Number: 5,692,825

[45] Date of Patent: Dec. 2, 1997

[54] TORCHES

[75] Inventor: Ram Shalvi, Hong Kong, Hong Kong

[73] Assignee: Solar Wide Industrial Ltd., Tsuen Wan, Hong Kong

[21] Appl. No.: 552,464

[22] Filed: Nov. 9, 1995

[51] Int. Cl.[6] ..... F21L 7/00

[52] U.S. Cl. ..... 362/183; 362/184; 362/226; 362/802

[58] Field of Search ..... 362/84, 183, 184, 362/226, 276, 802, 157

[56] References Cited

U.S. PATENT DOCUMENTS

| | | | |
|---|---|---|---|
| 3,233,091 | 2/1966 | Hunt | 362/183 |
| 3,825,740 | 7/1974 | Friedmann et al. | 362/183 |
| 4,177,500 | 12/1979 | Nicholl et al. | 362/183 |
| 4,218,637 | 8/1980 | Zelina, Jr. | 362/184 |
| 4,590,543 | 5/1986 | Chen | 362/183 |
| 4,647,832 | 3/1987 | Fenne et al. | 362/183 |
| 5,119,280 | 6/1992 | Yang | 362/183 |

*Primary Examiner*—Stephen F. Husar
*Assistant Examiner*—Sara Sachie Raab
*Attorney, Agent, or Firm*—Gunn, Lee & Miller, P.C.

[57] ABSTRACT

A torch which has re-chargeable batteries is provided with a plug 14 that fits a conventional domestic wall socket for automatic charging of the batteries. The plug 14 is retractable by relative rotation into a body 10 of the torch when not required. An electro luminescent sheet (not shown) is mounted behind an aperture in the body 10 so that a "glow" is provided whenever the plug is inserted in a live mains socket. The glow enables the torch to be conveniently used as a night light.

1 Claim, 2 Drawing Sheets

TORCHES

BACKGROUND OF THE INVENTION

It is already known to provide torches with re-chargeable batteries and incorporate some electric terminals that enable the torch to mount on top of a mains supplied charging unit when required to be re-charged. Previously, the torch itself did not incorporate a charging circuit or, where it did, did not have retractable plugs that enable the torch to be connected directly to a conventional wall socket for example. Further, if the wall socket was not in a well-illuminated place, the torch could not be readily located during the dark.

It is an object of the invention to overcome or at least reduce these problems.

SUMMARY OF THE INVENTION

According to the invention, there is provided a hand holdable torch including at least one re-chargeable battery and a charging circuit, an electrical plug mounted to the torch adapted to fit a domestic wall socket for receiving power to re-charge the battery, and low power illuminating means mounted to the torch for providing an illuminating light output whenever the plug is fitted to the socket.

The electrical plug may have two operative positions, in which in a first position the plug is contained wholly within the torch and in a second position terminals of the plug extends out of the housing to fit the socket.

The plug may be arranged to be electrically isolated from the torch when the plug is in its first position.

The plug may be mounted to pivot within the torch to move between the first and second positions.

The illuminating means may comprise a sheet of electro luminescent material.

A light sensitive switch may be arranged to electrically isolate the illuminating means when ambient illumination is greater than a predetermined magnitude.

BRIEF DESCRIPTION OF DRAWINGS

A torch according to the invention will now be described by way of example with reference to the accompanying drawings in which.

DETAILED DESCRIPTION OF PREFERRED EMBODIMENT

Figure 1:
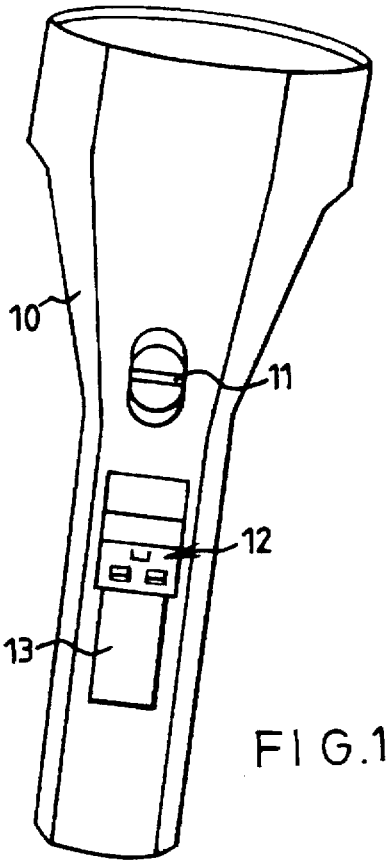
FIG. 1 is an isometric front view of the torch.
Figure 2:
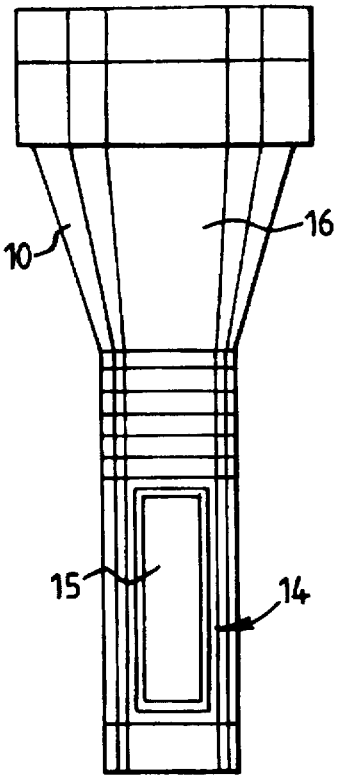
FIG. 2 is a rear plan view of the torch.

Referring to the drawings, in FIG. 1 the torch has a body 10 which supports slidably selector switch 11 that has three portions, OFF, ON and BLINK. A two pin plug 12 is mounted in the side of the body 10 and can pivot out of the body 10 (as shown in FIG. 1) or be contained wholly within the body 10 and closed-over by a sliding cover 13. As shown in FIG. 2, the body 10 has an aperture 14 behind which is supported a sheet 15 of electro luminescent material over which is mounted a thin transparent plastics protective cover.

Broadly described, the torch is powered by re-chargeable batteries which are re-charged when required via the plug 12. The plug is insertable into a standard domestic wall outlet socket of a mains supply during charging. The described torch also gives out a "glow" whenever the plug 12 is inserted into the socket because the sheet 15 is then connected directly across the mains supply. Such a glow is very convenient as a night light and also makes the torch easy to find or to locate in when mounted to a wall socket and required to be removed for normal use. The torch has a "charging" advisory bulb 16, in the form of a light emitting diode, and its main bulb (not shown) is also arranged to flash ON and OFF if the mains power fails when the plug 12 is in a mains socket. The bulb 16 will also turn ON if batteries are inserted in the torch with incorrect polarity.

Figure 3:
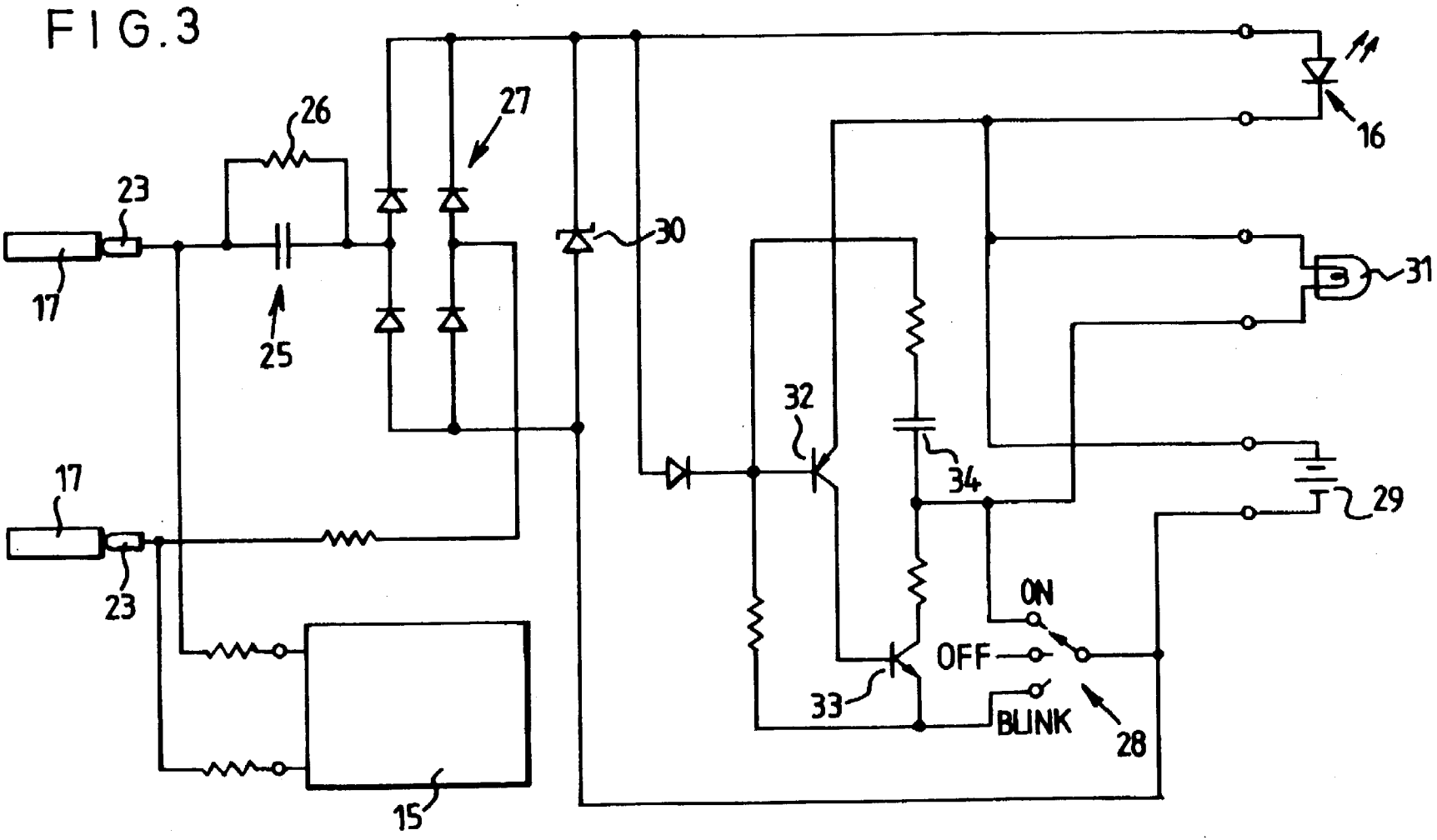
FIG. 3 is a circuit diagram for the torch.

In FIG. 3, input terminals 23 are arranged to receive mains power from conductors 17, as described below with reference to FIGS. 4 and 5, at 120 volts and 60 Hz. The terminals 23 are coupled via a capacitor 25, having a discharging resistor 26, a full-wave rectifier 27, formed by four diodes, and a three-position switch 28 to rechargeable batteries 29. A zener diode 30 limits the voltage supplied across the batteries. The switch 28 is provided normally to control the operation of a torch bulb 31 to be OFF, to be ON or to BLINK.

A timer circuit consists basically of two transistors 32 and 33 and a capacitor 34. Thus, with the switch 28 set to BLINK the transistor 33 will be controlled by the transistor 32 repeatedly to turn ON and OFF as the capacitor 34 automatically charges up and discharges accordingly. It will be noted that whenever power is being supplied from the rectifier 27, the transistors 32 and 33 remain OFF. In other words, the timer circuit, formed by these transistors, is inhibited and so that if the mains power fails during charging the torch bulb will BLINK.

The sheet 15 is connected by a pair of resistors 35 across the terminals 23. The resistors each have a high resistance, around 40K ohms, to restrict any current that might otherwise flow to a sharp object say that accidentally pierced the sheet 15; in other words, the resistors prevent the torch becoming "unsafe" during normal use even if damage and direct exposure of the sheet 15 occurs. Although the sheet 15 is permanently attached across the terminals 23 and hence the mains supply most of the times in practice the sheet uses very little power (around 1 Watt per 24 hours). Nevertheless, the sheet 15 provides a glow or illumination output that is sufficient for use as a normal "night light". (A photosensitive switch may however be connected in series with the sheet 15 to automatically switch its power supply OFF during daylight, say.) In any event, the glow enables the torch, which would normally be left "on charge" when not in use, to be readily located in a cupboard, garage or tool shed which may be otherwise unlit or dimly lit even during day time.

Figure 4:
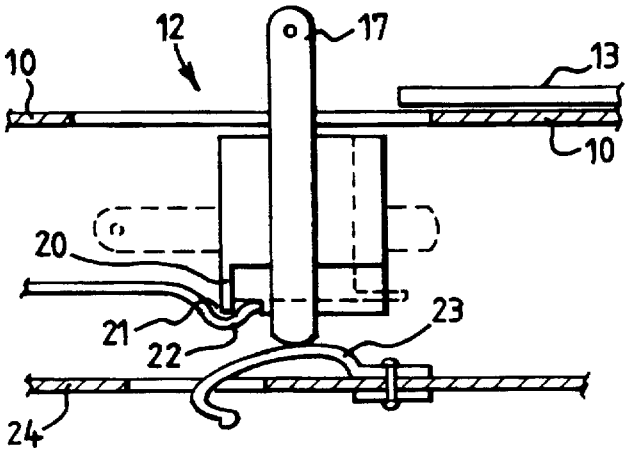
FIG. 4 is a part-sectioned more detailed side view of a plug for the torch.
Figure 5:
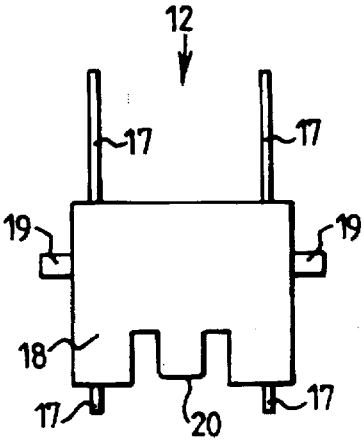
FIG. 5 is an end view of the plug.

In FIGS. 4 and 5, the plug 12 is provided with two conventionally shaped conductors 17 extending through and moulded in a central body 18 which is integrally formed with short stub axles 19. The axles 19 are mounted in use into cooperating apertures (not shown) integrally formed in the body 10. The central body 18 can pivot to arrange the plug in a first operative position shown dotted in FIG. 4 or a second operative position shown in full. In the first position, the plug 12 is stored in effect wholly within the body 10 and can be covered over by the sliding cover 13. In the second position, the plug is positioned to fit conveniently into a wall socket (not shown). It will be noted that in the second position, the plug 12 is resiliently held in this position by a tongue 20 which at that time fits in a recess 21 in a flap 22 integrally formed in the body 10. The action between the tongue 20 and the flap 22 enables the plug to "snap" into the second position and remain held in the second position with the conductors 17 extending out of and suitably orientated with the body 10. As such the plug 12 can be inserted into a mains socket while grasping only the body 10. When not mounted to a wall socket, the plug 12 is readily released by manually rotating the plug into the body 10 and closing the cover 13. This provides better safety and improved aesthetic appearance.

It will be noted in FIG. 4 that a pair (only one can be seen) of terminals 23 are mounted on a circuit board 24. The terminals 23 connects the ends of the conductors 17 in the plug 12 to the torch circuit when, and only when, the plug 12 is in the second position. The terminals 23 are resiliently mounted to a printed circuit board 24 to ensure good electrical contact is made and to provide an additional mechanical bias to tend to hold the tongue 20 more firmly in the recess 21.

In the described arrangement, the plug 12 is manually rotated between the first and second positions. It is possible when desired to provide a simple mechanical link between the cover 13 and the plug 12 which causes the plug 12 to rotate, as required, between its two positions when the cover 13 is slid along with respect to the body 10. Thus, the opening and closing of the cover serves to move the plug automatically between its two positions.

It will be noted that the power is derived from the mains supply using a capacitor 25. In currently available torches it is usual to use an isolation transformer which is more expensive and considerably heavier. An isolation transformer is however inherently safer to use. In the described torch, the electrical components are mounted on a printed circuit board 24 which is supported inside the body 10 a significant distance away from outer parts of the body 10, see FIG. 4. This separating distance means that in practical terms, the described torch is in fact as safe in use as a torch incorporating an isolation transformer. The described capacitor step-down is however much cheaper than a transformer and easier to make, uses less power and the overall weight of the torch is considerably reduced.

What is claimed is:

1. A hand holdable torch comprising:

at least one rechargeable battery and a charging circuit;

an electrical plug mounted to said torch adapted to fit a domestic wall socket for receiving power to re-charge said battery;

a low power illuminating means mounted to said torch for providing an illuminating light output whenever said plug is fitted to said socket;

a timer circuit and a blink selector switch to couple said timer circuit so as to supply power intermittently to a light bulb of said torch; and a circuit for inhibiting the operating of said timer circuit whenever said plug is inserted into a live mains socket.

* * * * *